US011897668B2

(12) United States Patent
Kuryak et al.

(10) Patent No.: US 11,897,668 B2
(45) Date of Patent: Feb. 13, 2024

(54) BEVERAGE CONTAINER TOPPER

(71) Applicant: Pivotal Brand Group, LLC, Santa Monica, CA (US)

(72) Inventors: Mark Kuryak, Santa Monica, CA (US); Chris Kuryak, Austin, TX (US)

(73) Assignee: Pivotal Brand Group, LLC, Santa Monica, CA (US)

( * ) Notice: Subject to any disclaimer, the term of this patent is extended or adjusted under 35 U.S.C. 154(b) by 618 days.

(21) Appl. No.: 17/052,617

(22) PCT Filed: Apr. 26, 2019

(86) PCT No.: PCT/US2019/029311
§ 371 (c)(1),
(2) Date: Nov. 3, 2020

(87) PCT Pub. No.: WO2019/226275
PCT Pub. Date: Nov. 28, 2019

(65) Prior Publication Data

US 2021/0237947 A1 Aug. 5, 2021

Related U.S. Application Data

(60) Provisional application No. 62/675,108, filed on May 22, 2018.

(51) Int. Cl.
*B65D 47/06* (2006.01)
*B65D 25/48* (2006.01)

(52) U.S. Cl.
CPC ..... *B65D 47/06* (2013.01); *B65D 25/48* (2013.01)

(58) Field of Classification Search
CPC .... B65D 25/48; B65D 25/50; B65D 43/0204; B65D 43/0208; B65D 47/06
See application file for complete search history.

(56) References Cited

U.S. PATENT DOCUMENTS 2,075,721 A * 3/1937 Hommel ..... B65D 25/48 220/717
5,632,407 A 5/1997 Christensen
(Continued)

FOREIGN PATENT DOCUMENTS

WO 02/28344 A2 4/2002

OTHER PUBLICATIONS

The International Search Report and The Written Opinion of the International Searching Authority, dated Jul. 9, 2019.
(Continued)

*Primary Examiner* — Andrew T Kirsch
(74) *Attorney, Agent, or Firm* — LambentIP

(57) ABSTRACT

A beverage container topper is disclosed. The beverage container topper has an interior hollow passage for beverage to flow, and comprises a cup section, a channel section and a fastening section, wherein the inner surface of the fastening section is formed to have two or more fastening structures for fastening two or more types of top portions, respectively, of beverage containers. A user may fasten the top portion of a beverage container to one of the two or more fastening structures, and tilt the combination of the beverage container and topper to flow out the beverage from the beverage container through the beverage container topper to his/her mouth.

4 Claims, 9 Drawing Sheets

(56) References Cited

U.S. PATENT DOCUMENTS 5,732,851 A * 3/1998 Griffin ..... B65D 25/48
220/759
5,947,324 A * 9/1999 Palinchak ..... B65D 25/48
220/717
6,155,452 A * 12/2000 Laurent ..... B65D 81/3876
220/737

OTHER PUBLICATIONS

Website "www.thecanleycup.com" launched Mar. 18, 2015, taken down May 20, 2015.

* cited by examiner

BEVERAGE CONTAINER TOPPER

CROSS REFERENCE

This PCT Application claims the benefit of the U.S. Provisional Patent Application No. 62/675,108, filed on May 22, 2018.

FIELD OF THE INVENTION

The present disclosure relates to topper devices for beverage containers.

BACKGROUND

Going out to observe a sports event has been, and will be, one of the activities favored by many people of all ages worldwide, irrespective of cultural or political differences. Examples of popular game events in the U.S.A. include but not limited to: NFL Games, NFL Super Bowl, MLB Games, MLB World Series, Collegiate Football Games, BCS Football Championships, Rose Bowl, NCAA Basketball Tournament, MLS Games, MLS Championship, FIFA World Cup, PGA/LPGA Tournaments & Championships, US Open, Motorsports Races & Championships, NASCAR, Formula 1, Indianapolis 500, AMA Supercross, X Games, ATP/WTA Tournaments & Championships, US Open, NHL Games, NHL Playoffs & Stanley Cup Final, NBA Games, NBA Finals, Little League World Series, etc. Massive amounts of a wide variety of beverages, e.g., soda, sports drink, juice, water, flavored tea, etc., are consumed in such an event.

In view of the variety and massive amounts of commercial beverages consumed or sold in such events, this document discloses a new type of beverage container toppers, each of which is configured to fit on a beverage can, a bottle or other beverage container containing a beverage that a user selected. The present beverage container topper may be customized according to the theme, sponsorship, organizer or other specifics of the event, including TV networks, corporate sponsors, advertisers, etc., where beverages are consumed or sold. The present beverage container topper so designed may serve to enhance the enjoyment and excitement during the event and may be kept by the user as a souvenir which may be re-used by the user outside the event. The present beverage container topper may be sold or used as a promotion item for a team, league, tournament, event, etc. in the form of a giveaway to fans for the specific game/event. The present beverage container topper may be used during the event and/or outside the event since it is configured to be reusable for consuming beverages at home, at celebration party, while tailgating, etc. In addition to sports events, the present beverage container topper may be customized for non-sports events such as music festivals, corporate events, trade shows, charity events/causes, conferences, etc.

DETAILED DESCRIPTION

Figure 1:
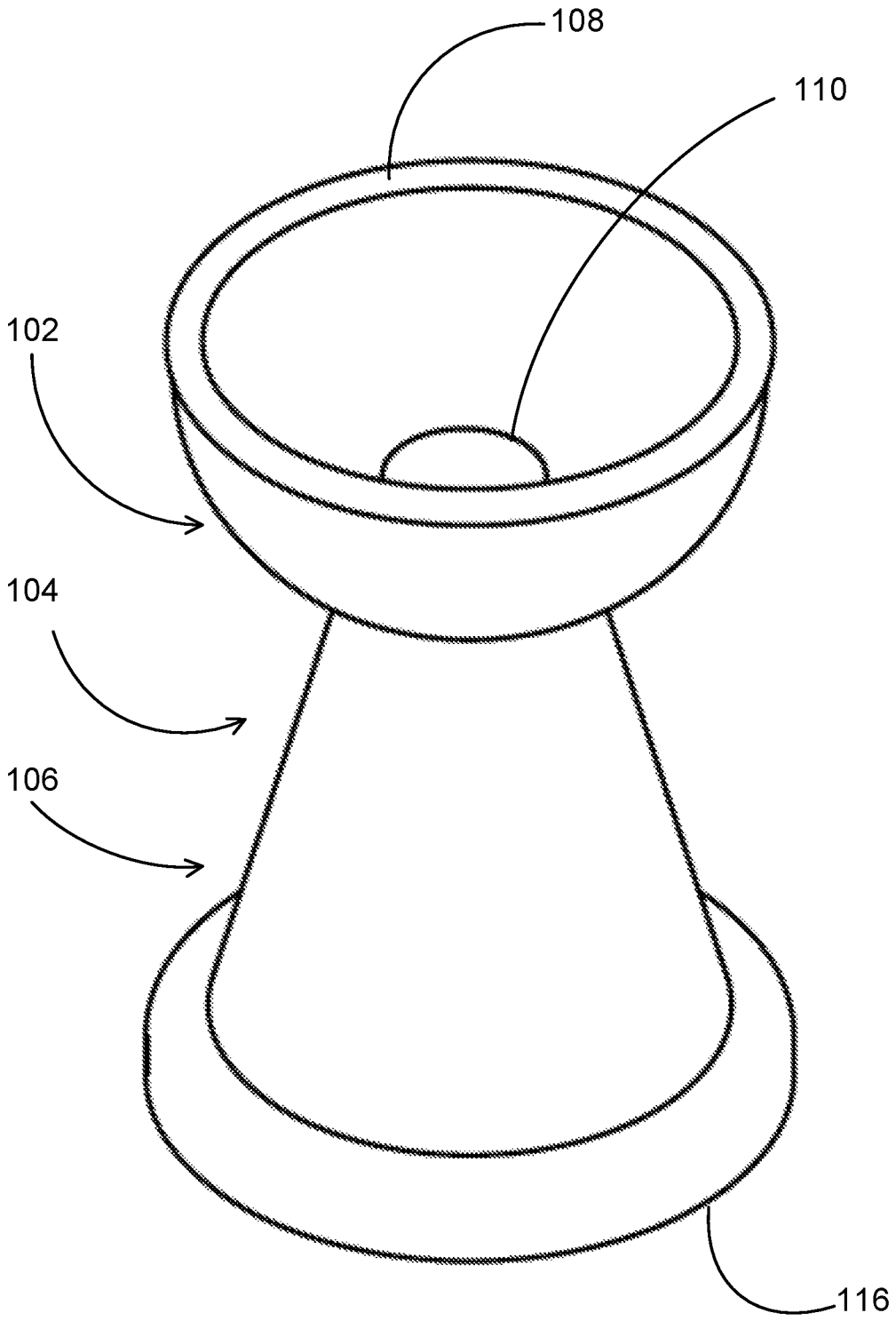
FIGS. 1-3 illustrate a front perspective view, a front view and a top view, respectively, of an example of the beverage container topper according to an embodiment.
Figure 2:
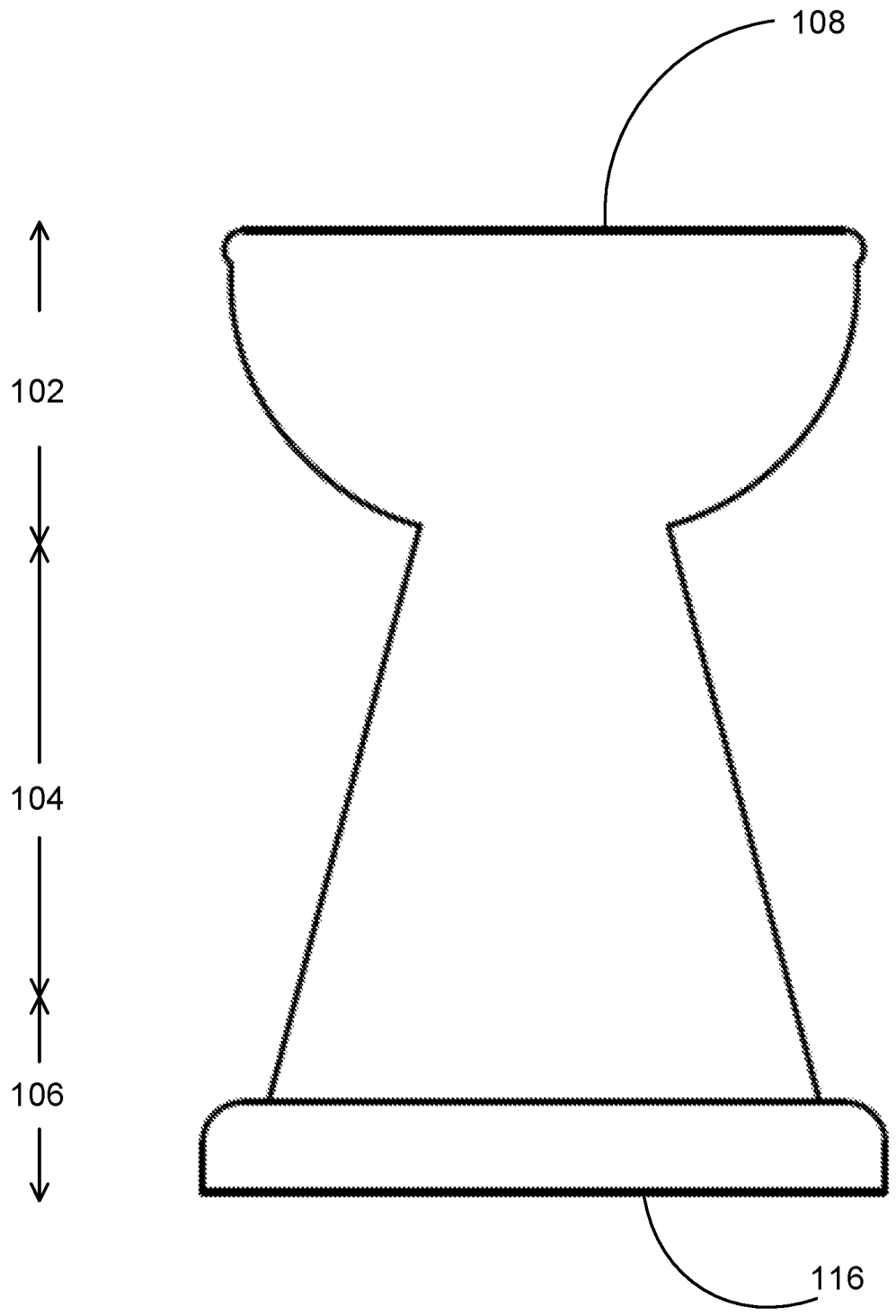
Figure 3:
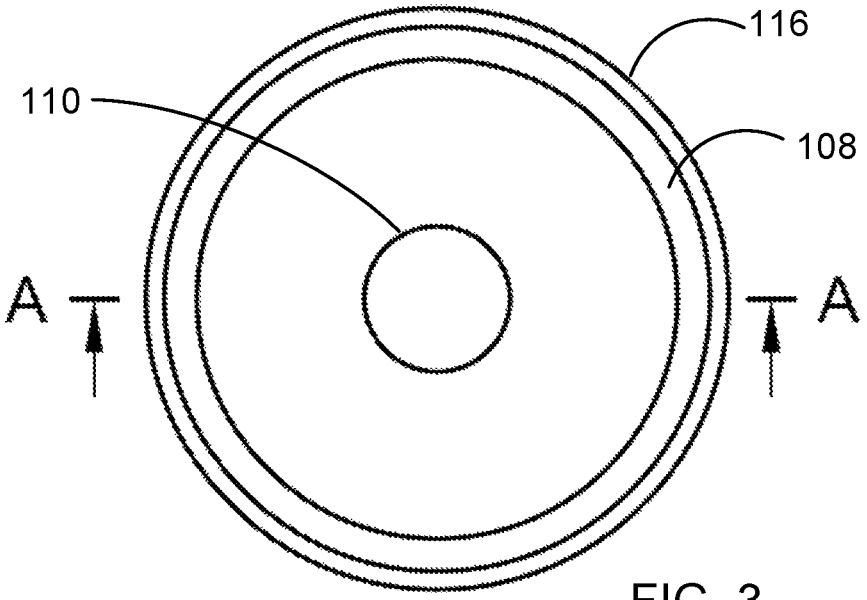
Figure 4:
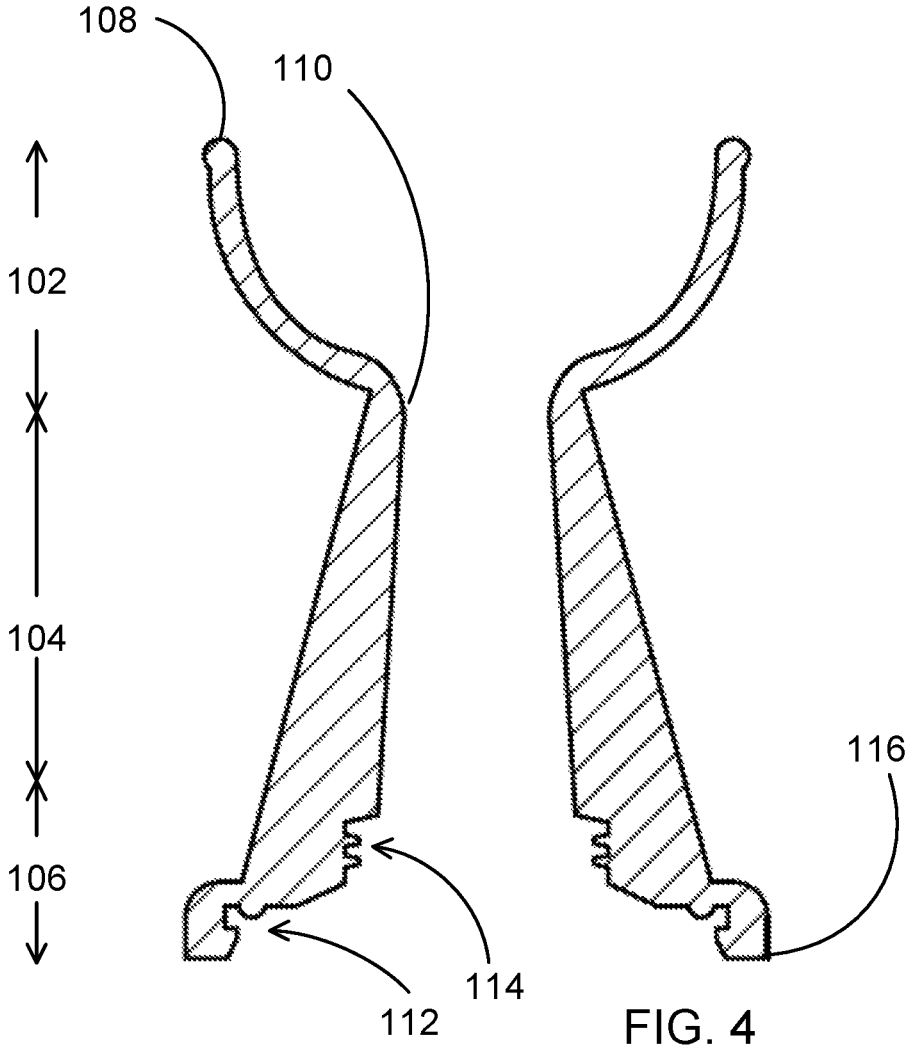
FIG. 4 illustrates a cross-sectional view thereof, on the plane A-A indicated in FIG. 3.
Figure 5:
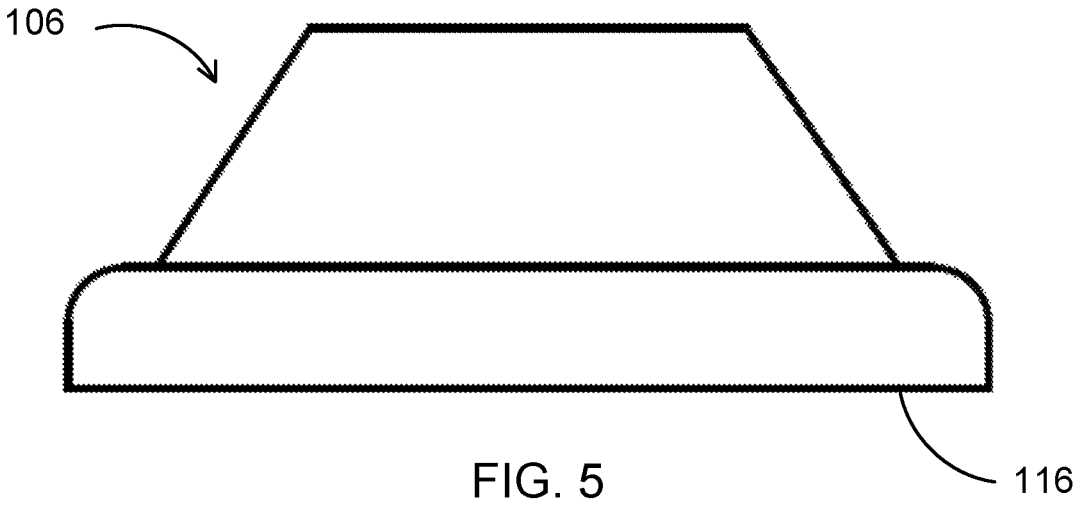
FIGS. 5-8 illustrate a front view, a front perspective view, a bottom view and a cross-sectional view on the plane A-A indicated in FIG. 7, respectively, of the fastening section of the present beverage container topper.
Figure 6:
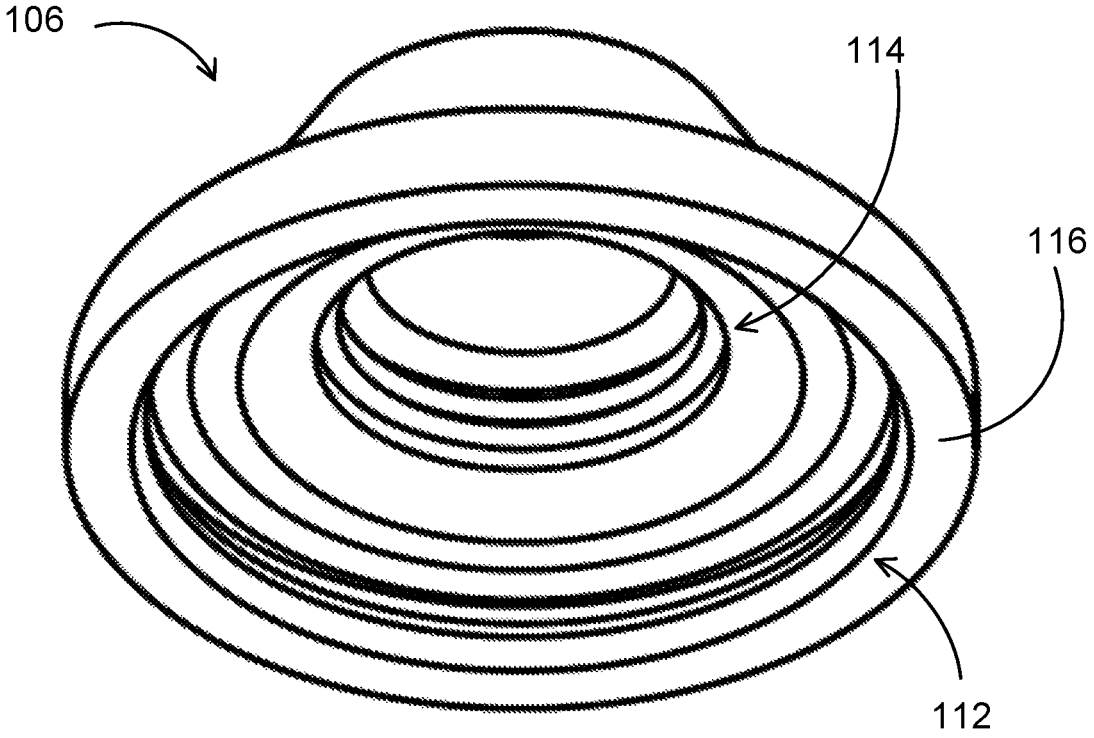

FIGS. 1-3 illustrate a front perspective view, a front view and a top view, respectively, of an example of the beverage container topper according to an embodiment. FIG. 4 illustrates a cross-sectional view thereof, on the plane A-A indicated in FIG. 3. The beverage container topper in this example is formed to have a generally cylindrical interior hollow passage for beverage to flow, the beverage container topper comprising a cup section 102, a channel section 104 and a fastening section 106. The overall interior as well as exterior shapes of the beverage container topper may be designed to be cylindrically symmetric or non-symmetric, i.e., cylindrically regular or irregular around its axis. The cup section 102 is formed to have a generally bowl-shaped structure, having a top rim 108 defining a top opening and a bottom rim 110 defining a bottom opening of the cup section 102. The channel section 104 is contiguously formed with the cup section 102, having the inner surface contiguously connected to the inner edge portion of the bottom rim 110 of the cup section 102, to have a generally tunnel-shaped structure for providing a channel for beverage to flow between the cup section 102 and the fastening section 106. The fastening section 106 is contiguously formed with the channel section 104, wherein the fastening section 106 has the inner surface contiguously connected to the inner surface of the channel section 104 at one end and to a base rim 116 defining a base opening at the other end. In the example illustrated in FIG. 4, the inner surface of the fastening section 106 is formed to have two types of fastening structures 112 and 114 to fasten two types of beverage containers, respectively, having two different top portions in size and shape. In this example, the base rim 116 is illustrated to be slightly wider than the top rim 108; however, the top rim 108 may be made wider than the base rim 116, or the respective shapes may be made different, depending on the sizes of beverage containers to be used, aesthetics and other factors.

Examples of beverage containers may include: 20 oz Coca-Cola® plastic bottle, Dasani® plastic bottle, Gatorade® plastic bottle, 12 oz Coca-Cola® can, and various other commercially available beverage bottles and cans. The dimensions of these containers vary from volume to volume, from manufacturer to manufacturer, from country to country. However, in the U.S., the dimensions of container tops are mostly standardized. For example, the diameter at the narrowed top portion of a 12 oz Coca-Cola can is about 2.13 inches (~5.4 cm); the top portion of a 20 oz Coca-Cola bottle or Dasani bottle has a thread per PCO1881 (International Society of Beverage Technologies) with a diameter of about 1.08 inches (~2.7 cm) measured at the crest (T-dimension); the top portion of a Gatorade bottle has a thread per 2030 GPI 2-Lead (Glass Packaging Institute) with a diameter of about 1.5 inches (~3.8 cm) measured at the crest (T-dimension). In the example shown in FIG. 4, the inner surface of the fastening section 106 is formed to have the first and second fastening structures 112 and 114; however, one or more fastening structures may be made to fasten one or more types of top portions, respectively, of beverage containers. Having two or more fastening structures may provide more options to users in selecting a beverage among multiple types of beverages sold or offered in the event, or in the case where the user wants to enjoy two or more different types of beverages.

Figure 7:
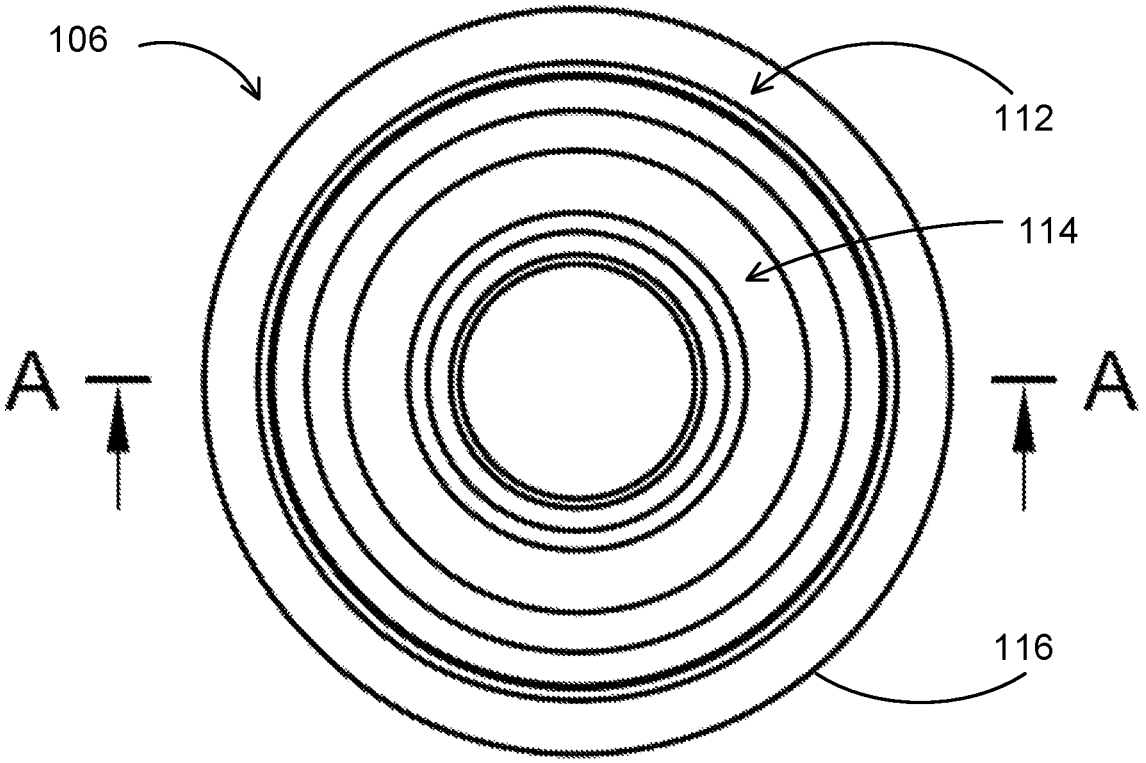
Figure 8:
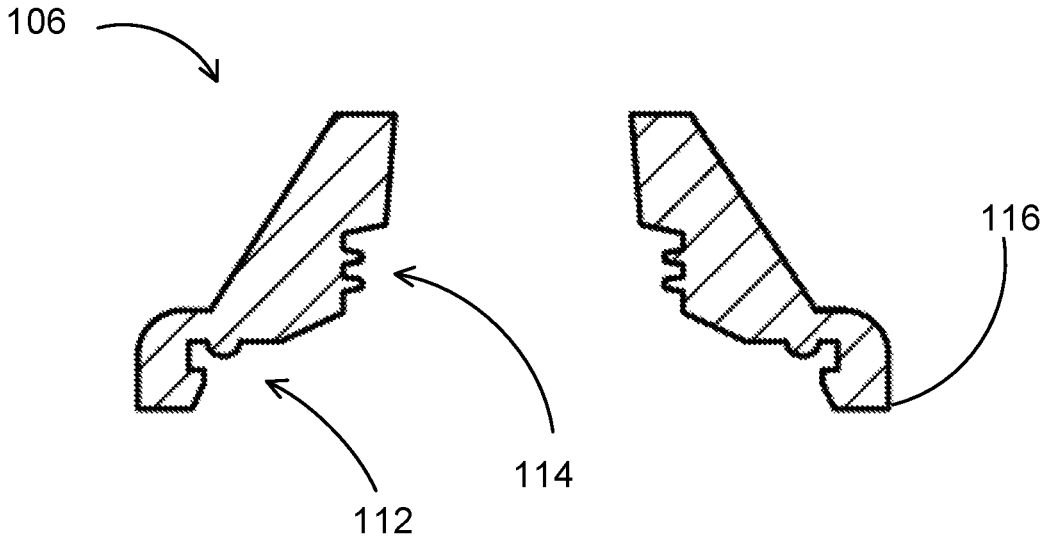

FIGS. 5-8 illustrate a front view, a front perspective view looking up from the front bottom side, a bottom view, and a cross-sectional view on the plane A-A indicated in FIG. 7, respectively, of the fastening section 106 of the present beverage container topper. As shown in this example, the first and second fastening structures 112 and 114 are formed to have different overall horizontal dimensions, i.e., the first and second horizontal dimensions, respectively, wherein the first horizontal dimension is larger than the second horizontal dimension, and the first fastening structure 112 with the larger horizontal dimension is formed below the second fastening structure 114. This configuration allows a user, according to his/her choice, to put the present beverage container topper on a beverage container having the top portion with the larger horizontal dimension by using the first fastening structure 112 or on a beverage container having the top portion with the smaller horizontal dimension by using the second fastening structure 114.

Figure 9:
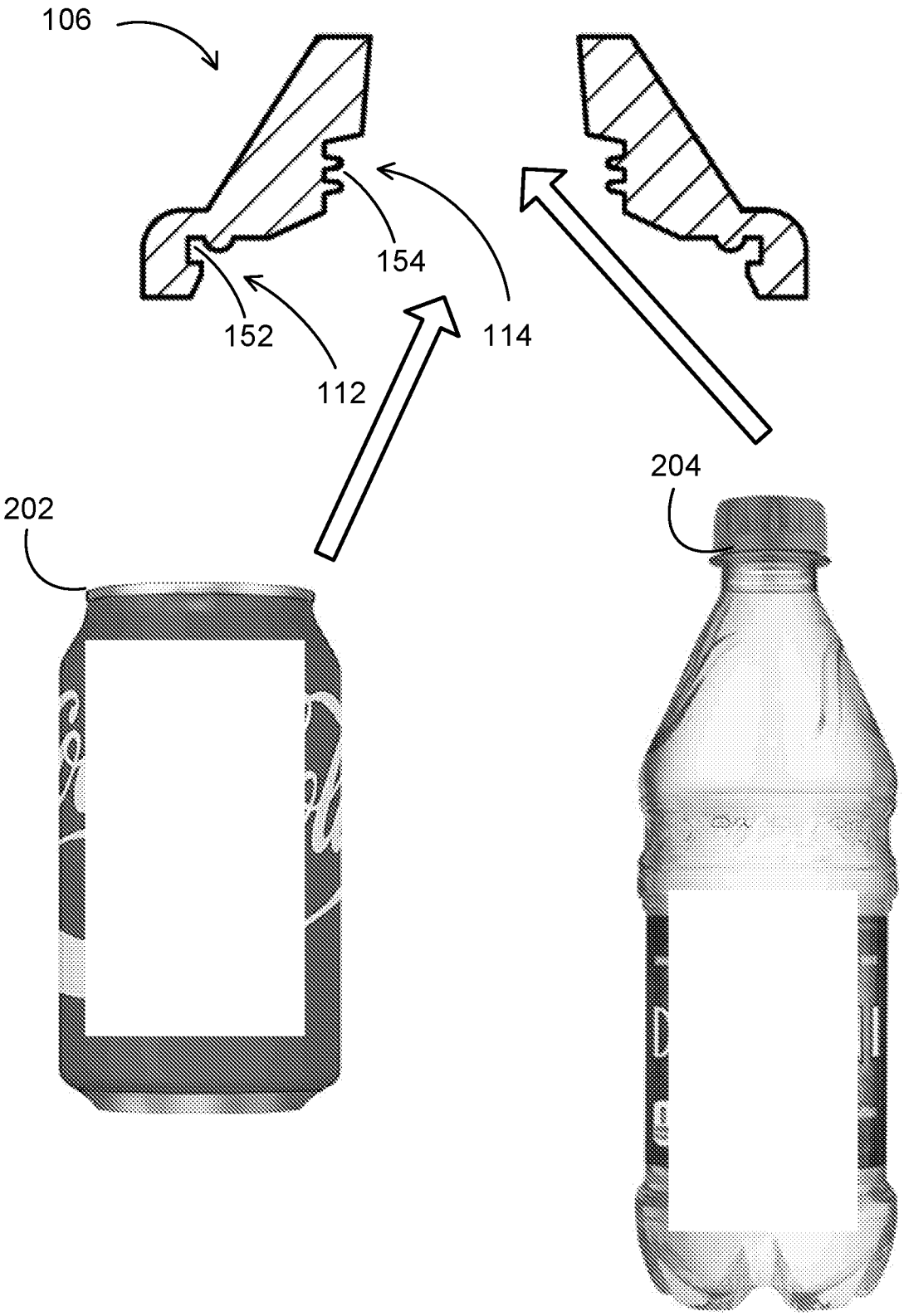
FIG. 9 illustrates that: the first fastening structure includes a circular groove formed on the inner surface of the fastening section to fasten the top portion of a beverage can; and the second fastening structure includes a thread formed on the inner surface of the fastening section above the first fastening structure to fasten the top portion of a beverage bottle.

FIG. 9 illustrates that: the first fastening structure 112 includes a circular groove 152 formed on the inner surface of the fastening section 106 to fasten the top portion of a beverage can, e.g., a 20 oz Coca-Cola can, by engaging the circular top rim 202 of the can with the circular groove 152; and the second fastening structure 114 includes a thread 154 formed on the inner surface of the fastening section 106 above the first fastening structure 112 to fasten the top portion of a beverage bottle, e.g., a Dasani bottle, by engaging the corresponding thread 204 formed on the outer surface of the top portion of the bottle (after removing the cap in this figure) with the thread 154.

Figure 10:
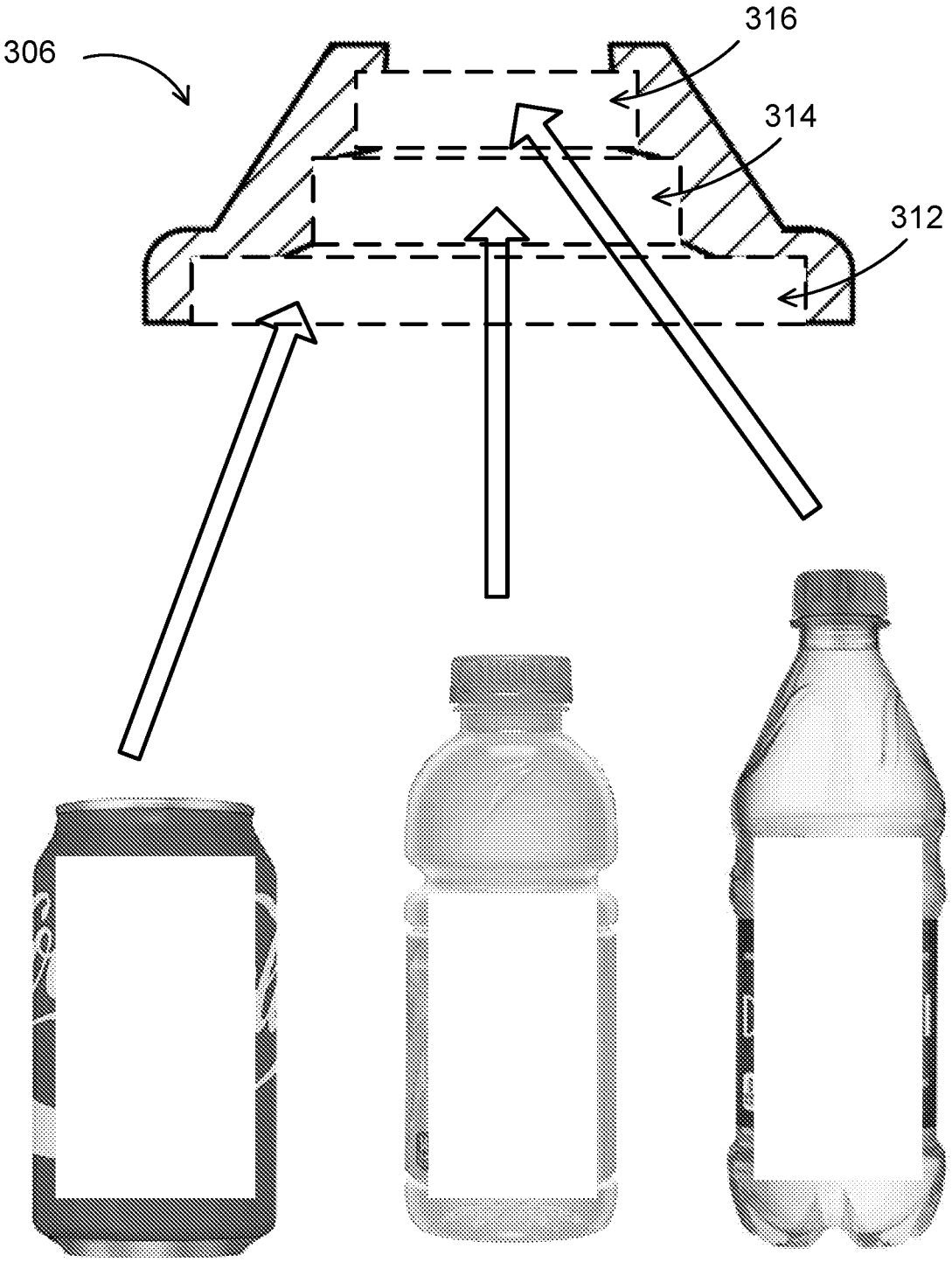
FIG. 10 illustrates another example of the beverage container topper according to an embodiment, wherein a fastening section is formed to include three different types of fastening structures.

In the example explained thus far, the inner surface of the fastening section 106 is formed to have the first and second fastening structures 112 and 114; however, one or more fastening structures may be formed to fasten one or more types of top portions, respectively, of beverage containers. Having two or more fastening structures may provide more options to users in selecting a beverage among multiple types of beverages sold or offered in the event, or in the case where the user wants to enjoy two or more different types of beverages. FIG. 10 illustrates another example of the beverage container topper according to an embodiment, wherein a fastening section 306 is formed to include three different types of fastening structures 312, 314 and 316. These first, second and third fastening structures 312, 314 and 316 are formed on the inner surface of the fastening section 306 in a sequence of largest to smallest in horizontal dimension as going vertically from the base rim 116 toward the channel section 114. In this example, the first fastening structure 312 may include a circular groove formed on the inner surface of the fastening section 306 to fasten the top portion of a beverage can, e.g., a 20 oz Coca-Cola can, by engaging the circular top rim of the can with the circular groove; the second fastening structure 314 may include a first thread formed on the inner surface of the fastening section 306 above the first fastening structure 312 to fasten the top portion of a beverage bottle, e.g., a Gatorade bottle, by engaging the corresponding thread formed on the outer surface of the top portion of the bottle (after removing the cap) with the first thread; and the third fastening structure 316 may include a second thread formed on the inner surface of the fastening section 306 above the second fastening structure 314 to fasten the top portion of another beverage bottle, e.g., a Dasani bottle, by engaging the corresponding thread formed on the outer surface of the top portion of the bottle (after removing the cap) with the second thread.

Figure 11:
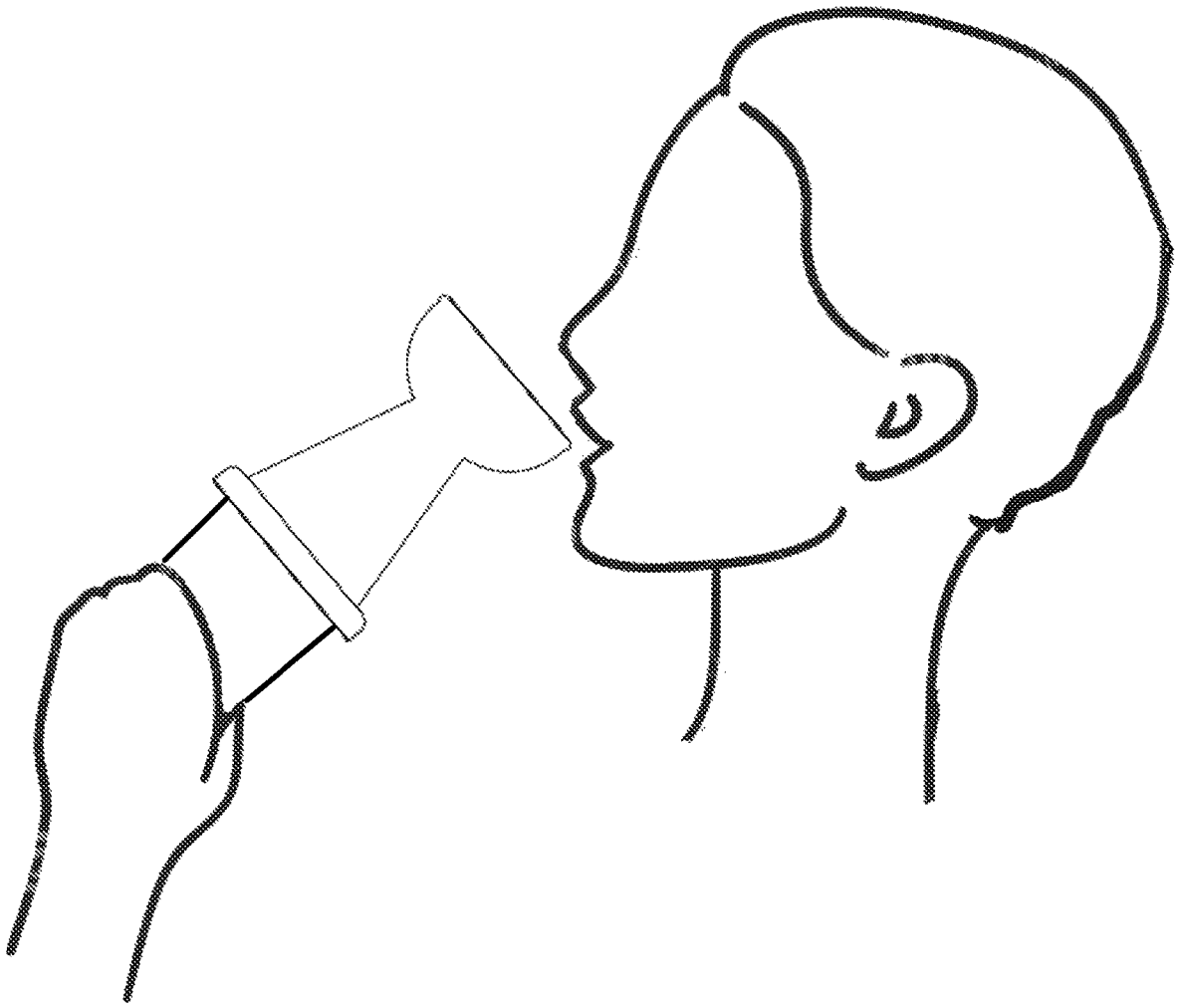
FIG. 11 illustrates a schematic side view of a user holding the beverage container fastened to the beverage container topper.

The scenario of using the beverage container topper is explained with reference to FIG. 11, which illustrates a schematic side view of a user holding the beverage container fastened to the beverage container topper, the combination of which is tilted by his/her hand to flow out the beverage from the beverage container through the beverage container topper to his/her mouth. For doing this, the user first selects/purchases his/her beverage; removes a cap or lid or lifts a tab to open the beverage container; inserts the top portion of the beverage container through the base opening into the fastening section; fastens the top portion of the beverage container to a fastening structure corresponding to the top portion, the fastening structure being selected from the two or more fastening structures formed on the inner surface of the fastening section; and tilts the combination of the beverage container and the beverage container topper to flow out the beverage from the beverage container through the beverage container topper to his/her mouth.

The present beverage container topper may be made of a plastic based on injection molding, for example, for easy snap-in or turning-in of a top portion of any commercially available beverage container into the fastening section. Additionally, the outer design of the beverage container topper may be customized using the plastic molding technique or any other fabrication technique suitable for mass production. The customization may be made according to the theme, sponsorship, organizer or other specifics of the occasions where beverages are consumed, offered or sold for a massive crowd. For example, the outer design may be configured to illustrate the logo and/or brand image of a sports event (with the permission of or collaboration with the trademark/copyright holder), such sports events including but not limited to: NFL Games, NFL Super Bowl, MLB Games, MLB World Series, Collegiate Football Games, BCS Football Championships, Rose Bowl, NCAA Basketball Tournament, MLS Games, MLS Championship, FIFA World Cup, PGA/LPGA Tournaments & Championships, US Open, Motorsports Races & Championships, NASCAR, Formula 1, Indianapolis 500, AMA Supercross, X Games, ATP/WTA Tournaments & Championships, US Open, NHL Games, NHL Playoffs & Stanley Cup Final, NBA Games, NBA Finals, Little League World Series, etc.

Figure 12:
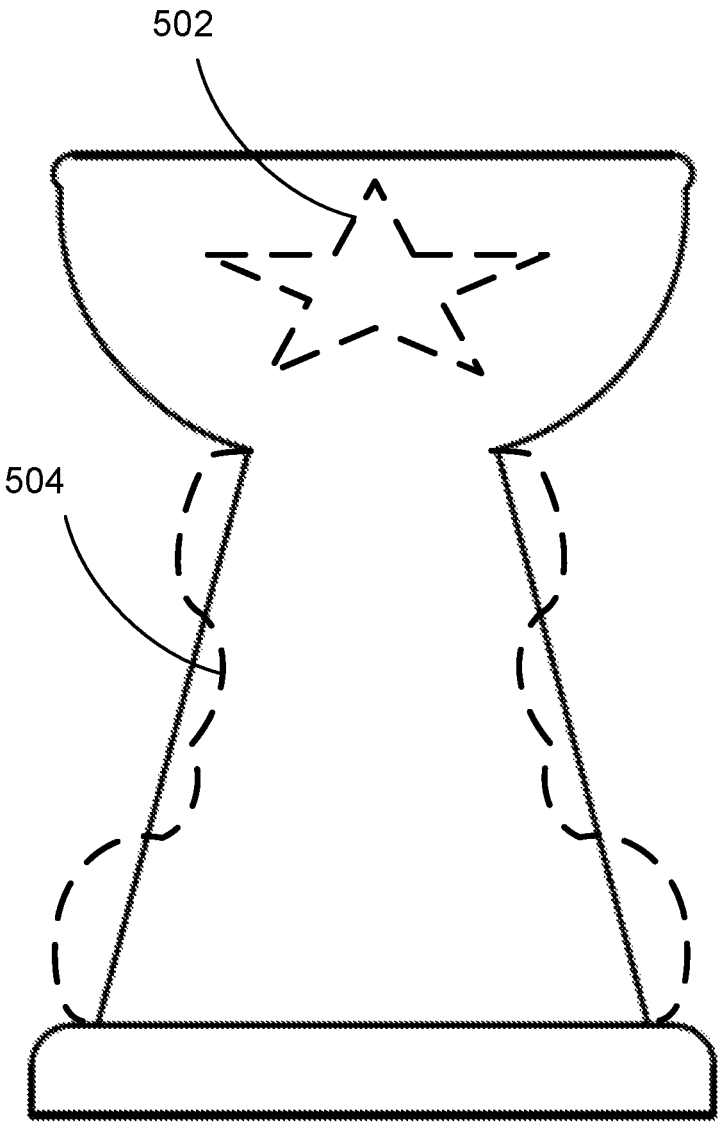
FIG. 12 illustrates an example of the outer design of the beverage container topper.

FIG. 12 illustrates an example of the outer design of the beverage container topper to be used for drinking beverages consumed, offered or sold in an event and/or outside the event, which is recognized with a logo 502 and/or a shape 504. The outer design may be customized according to the event. The inner surface may be formed to have multiple fastening structures, so that each person of the crowd may be able to choose his/her favorite beverage to fit into the beverage container topper designed for the specific event, or to drink two or more different beverages available for the event. The beverage container topper, designed as above, serves to enhance the enjoyment and excitement during the event; and it may be kept by the user as a souvenir which may be re-used by the user outside the event, e.g., at home, at celebration party, while tailgating, etc.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. A beverage container topper comprising:

a cup section formed to have a generally bowl-shaped structure having a top rim defining a top opening and a bottom rim defining a bottom opening;

a channel section formed to have a generally tunnel-shaped structure contiguously formed with the cup section, the channel section having an inner surface contiguously connected to an inner edge portion of the bottom rim of the cup section to provide a channel for beverage to flow; and a fastening section contiguously formed with the channel section, the fastening section having an inner surface contiguously connected to the inner surface of the channel section at one end and to a base rim defining a base opening at the other end of the fastening section, the inner surface of the fastening section being formed to have two or more fastening structures for fastening two or more types of top portions, respectively, of beverage containers, wherein at least one of the two or more fastening structures comprises a thread circularly formed on the inner surface of the fastening section to fasten the top portion of a beverage bottle as the beverage container, by engaging a corresponding thread formed on an outer surface of the top portion of the beverage bottle with the thread in the fastening structure, wherein at least another one of the two or more fastening structures comprises a circular groove formed on the inner surface of the fastening section to fasten the top portion of a beverage can as the beverage container, by engaging a circular too rim of the beverage can with the circular groove in the fastening structure, and wherein a diameter of the circular thread is smaller than a diameter of the circular groove.

2. The beverage container topper of claim 1, wherein the two or more fastening structures are formed in a sequence of largest to smallest in horizontal dimension as going vertically from the base rim toward the channel section.

3. The beverage container topper of claim 1, wherein the beverage container topper is made of a plastic to provide easy snap-in or tuning-in of the top portion of a beverage container into the fastening section and to allow for customizing an outer design thereof for an event.

4. A method of drinking beverage from a beverage container by using the beverage container topper of claim 1, the method comprising:

removing a cap or lid or lifting a tab to open the beverage container;

inserting the top portion of the beverage container through the base opening into the fastening section;

fastening the top portion of the beverage container to a fastening structure corresponding to the top portion, the fastening structure being selected from the two or more fastening structures formed on the inner surface of the fastening section; and tilting a combination of the beverage container and the beverage container topper to flow out the beverage from the beverage container through the beverage container topper to a mouth.

* * * * *